US010054291B2

(12) United States Patent
MacIntosh

(10) Patent No.: US 10,054,291 B2
(45) Date of Patent: Aug. 21, 2018

(54) DIRECTABLE LIGHT

(71) Applicant: INTERNATIONAL BUSINESS MACHINES CORPORATION, Armonk, NY (US)

(72) Inventor: Fraser I. MacIntosh, Reading (GB)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/399,919

(22) Filed: Jan. 6, 2017

(65) Prior Publication Data

US 2018/0195695 A1 Jul. 12, 2018

(51) Int. Cl.

| | |
|---|---|
| ***F21V 14/00*** | (2018.01) |
| ***F21V 13/02*** | (2006.01) |
| ***F21V 7/00*** | (2006.01) |
| ***F21S 8/10*** | (2006.01) |
| ***F21S 41/64*** | (2018.01) |

(52) U.S. Cl.
CPC ..... *F21V 14/003* (2013.01); *F21S 41/645* (2018.01); *F21S 48/1731* (2013.01); *F21V 7/00* (2013.01); *F21V 13/02* (2013.01)

(58) Field of Classification Search
CPC .... F21V 14/003; F21S 48/1731; F21S 48/171
See application file for complete search history.

(56) References Cited

U.S. PATENT DOCUMENTS

| | | | | |
|---|---|---|---|---|
| 4,217,627 | A | 8/1980 | Tomita et al. | |
| 4,506,315 | A * | 3/1985 | Maekawa | F21S 48/1172 362/297 |
| 4,985,816 | A * | 1/1991 | Seko | B60Q 1/0023 362/268 |
| 5,023,758 | A * | 6/1991 | Allen | B60Q 1/1438 362/309 |
| 7,972,045 | B2 | 7/2011 | Schofield | |
| 8,536,789 | B2 | 9/2013 | Chen et al. | |
| 8,874,312 | B2 | 10/2014 | Park et al. | |
| 2007/0201240 | A1 | 8/2007 | Kovach | |

(Continued)

OTHER PUBLICATIONS

Rajesh, "Automatic Headlamp Steering System," International Journal of Engineering Development and Research, vol. 2, Issue 2, 2014 (5 pages).

(Continued)

*Primary Examiner* — Mary Ellen Bowman
(74) *Attorney, Agent, or Firm* — Griffiths & Seaton PLLC

(57) ABSTRACT

A directable light, the light comprising: a light source for generating light; a first reflector for forming said generated light into a beam; a light switching layer, located between said light source and said first reflector, said light switching layer comprising a plurality of portions, each of said portions having at least two states, in a first state said light switching layer being substantially transparent to said generated light and in a second state said light switching layer being substantially opaque to said generated light; and a light controller which determines which of said portions of said light switching layer are substantially transparent and which of said portions of said light switching layer are substantially opaque.

12 Claims, 8 Drawing Sheets

(56) References Cited

U.S. PATENT DOCUMENTS

| | | | | |
|---|---|---|---|---|
| 2013/0073144 | A1 | 3/2013 | Huster et al. | |
| 2015/0354772 | A1* | 12/2015 | Chen | B60Q 1/12 362/516 |

OTHER PUBLICATIONS

Makwana et al., "Design and Manufacture of Movable Headlight System in Automobile," International Journal of Innovative and Emerging Research in Engineering, vol. 1, Issue 2, 2014 (5 pages).

* cited by examiner

DIRECTABLE LIGHT

BACKGROUND

The present invention relates to a directable light, and more particularly to a directable light in which portions of a generated beam can be blanked to provide directionality.

Vehicle headlights have for many years been able to be mechanically directed to point in the direction the vehicle intends to travel. However, such systems are typically mechanical and thus are expensive and prone to wear.

Vehicle manufacturers typically produce two different headlight units, one for left hand drive vehicles and one for right hand drive vehicles, to direct the dipped headlight beam toward the curb, rather than into incoming traffic.

Traveling from a left hand drive area to a right hand drive area, such as someone from the United Kingdom traveling to continental Europe, requires modifications to the vehicle headlights to ensure oncoming traffic is not dazzled.

SUMMARY

According to an embodiment of the invention, a directable light comprises a light source for generating light; a first reflector for forming said generated light into a beam; a light switching layer, located between said light source and said first reflector, said light switching layer comprising a plurality of portions, each of said portions having at least two states, in a first state said light switching layer being substantially transparent to said generated light and in a second state said light switching layer being substantially opaque to said generated light; and a light controller which determines which of said portions of said light switching layer are substantially transparent and which of said portions of said light switching layer are substantially opaque.

In an embodiment, said light switching layer comprises a liquid crystal panel.

In an embodiment, at least a first portion of said first reflector is located at a different distance from said light source from at least a second portion of said first reflector.

In a preferred embodiment, said light controller comprises a first predetermined configuration which causes said switching layer to have portions which are substantially transparent and portions which are substantially opaque so as to direct said beam to the right, suitable for a vehicle used on a road where vehicles drive on the right hand side of the road and a second predetermined configuration which causes said switching layer to have portions which are substantially transparent and portions which are substantially opaque so as to direct said beam to the left, suitable for a vehicle used on a road where vehicles drive on the left hand side of the road.

In another embodiment, said light controller comprises a predetermined configuration which causes said switching layer to have portions which are substantially transparent and portions which are substantially opaque so as to direct said beam according to the direction in which the car is turning.

In another embodiment, said light controller comprises a predetermined configuration which causes said switching layer to have portions which are substantially transparent and portions which are substantially opaque so as to direct said beam to vary the beam angle relative to the ground.

In another embodiment, said light controller comprises a predetermined configuration which causes said switching layer to have portions which are substantially transparent and portions which are substantially opaque so as to direct said beam to maintain a substantially constant angle relative to the ground.

Embodiments of the invention provide a method of configuring the output of a light source in a vehicle, the method comprising: providing a first reflector for forming the output of the light source into a beam, the first reflector located in directions contained within a hemisphere centered on the light source; providing a light switching layer, located between the light source and the first reflector, the light switching layer comprising a plurality of portions, each portion having at least two states, in a first state being substantially transparent to the generated light and in a second state being substantially opaque to the generated light; and providing a light controller which determines which portions of the light switching layer are substantially transparent and which portions are substantially opaque.

BRIEF DESCRIPTION OF THE DRAWINGS

Preferred embodiments of the present invention will now be described in more detail, by way of example only, with reference to the accompanying drawings, in which.

DETAILED DESCRIPTION

Figure 1:
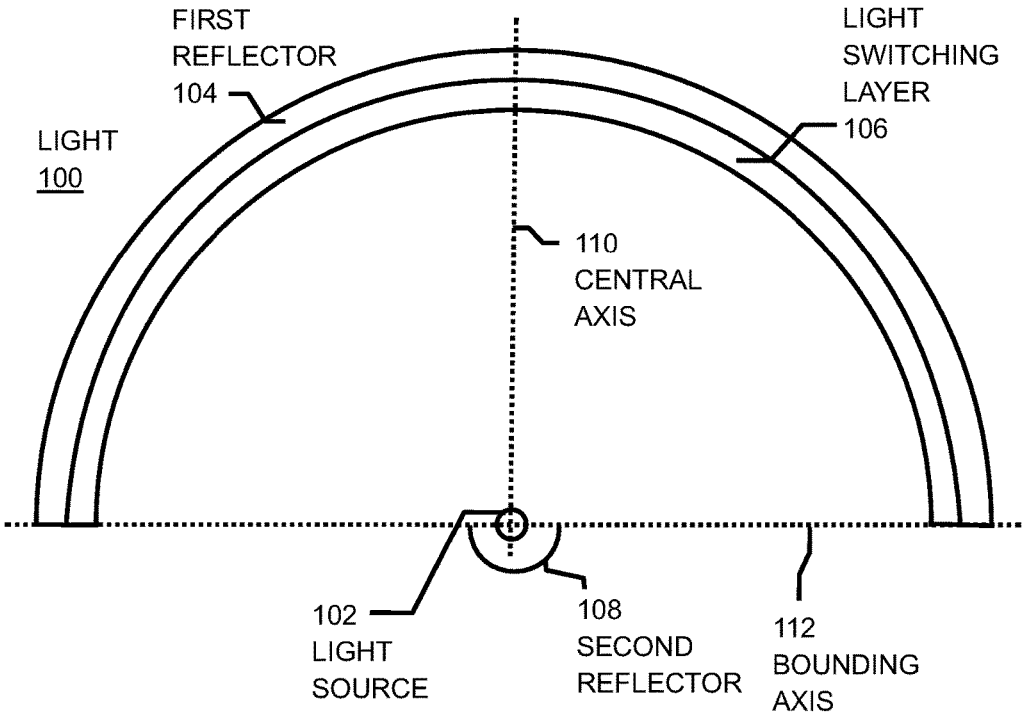
FIG. 1 shows a cross section view of a directable light according to an embodiment of the present invention.

FIG. 1 shows a directable light 100 according to an embodiment of the present invention. A light source 102 is located adjacent to a first reflector 104. Light source 102 may be located as shown in FIG. 1 along a bounding axis 112 joining opposite ends of the first reflector 104. In another embodiment, light source 102 may be located within the area bounded by the bounding axis 112 and the first reflector 104. In an embodiment, light source 102 may be located along a central axis 110 of the first reflector 104. In another embodiment, light source 102 may be located offset from a central axis 110 of the first reflector 104.

First reflector 104 may be a hemispherical shape as shown in FIG. 1, in which each portion of the first reflector 104 is a constant distance from light source 102. In another embodiment, first reflector 104 is a parabolic reflector. In an embodiment, light source 102 is located at a focal point of the parabolic first reflector 104 so as to produce a parallel beam from the first reflector 104. For a parabolic first reflector 104, the focal point is located at a distance f along the central axis 110 from the first reflector 104, where $f=(D/2)^2/(4d)$, D=the aperture diameter across the reflector and d=the reflector depth. In another embodiment, the light source 102 is located closer to the parabolic first reflector 104 than its focal point so as to produce a divergent beam from the first reflector 104. In yet another embodiment, the light source 102 is located further from the parabolic first reflector 104 than its focal point so as to produce a convergent beam from the first reflector 104. In other embodiments, first reflector 104 may be any other shape, such as, for example, a spherical concave reflector, a bifocal reflector having two reflector sections with different focal points so as to improve the illumination of the ground just in front of a vehicle or it may be a homo-focal reflector having a number of sections each having a common focal point.

Light source 102 may be a conventional filament bulb, it may be a halogen filled filament bulb, it may be an LED bulb or it may be a xenon (high intensity discharge) bulb or it may be any other form of light source. First reflector 104 may typically be made of compression-molded or injection-molded plastic, though glass and metal optic reflectors may also be used. The reflective surface of first reflector 104 is typically vapor deposited aluminum, with a clear overcoating to prevent the extremely thin aluminum from oxidizing. An optional second reflector 108 may be used in order to optimize the projected beam from the light by preventing direct light from the light source 102 from being seen and also to increase the amount of light that is reflected from the first reflector 104 and controlled by the light switching layer 106.

Light switching layer 106 is located between the light source 102 and the first reflector 104. Light switching layer 106 comprises a plurality of portions, each portion having at least two states, in a first state being substantially transparent to the generated light and in a second state being substantially opaque to the generated light. Light switching layer 106 may be, for example, a liquid crystal display (LCD). Other forms of light switching layer may be used, so long as they have a state where they are substantially transparent to light and a state where they are substantially opaque to light.

Figure 2:
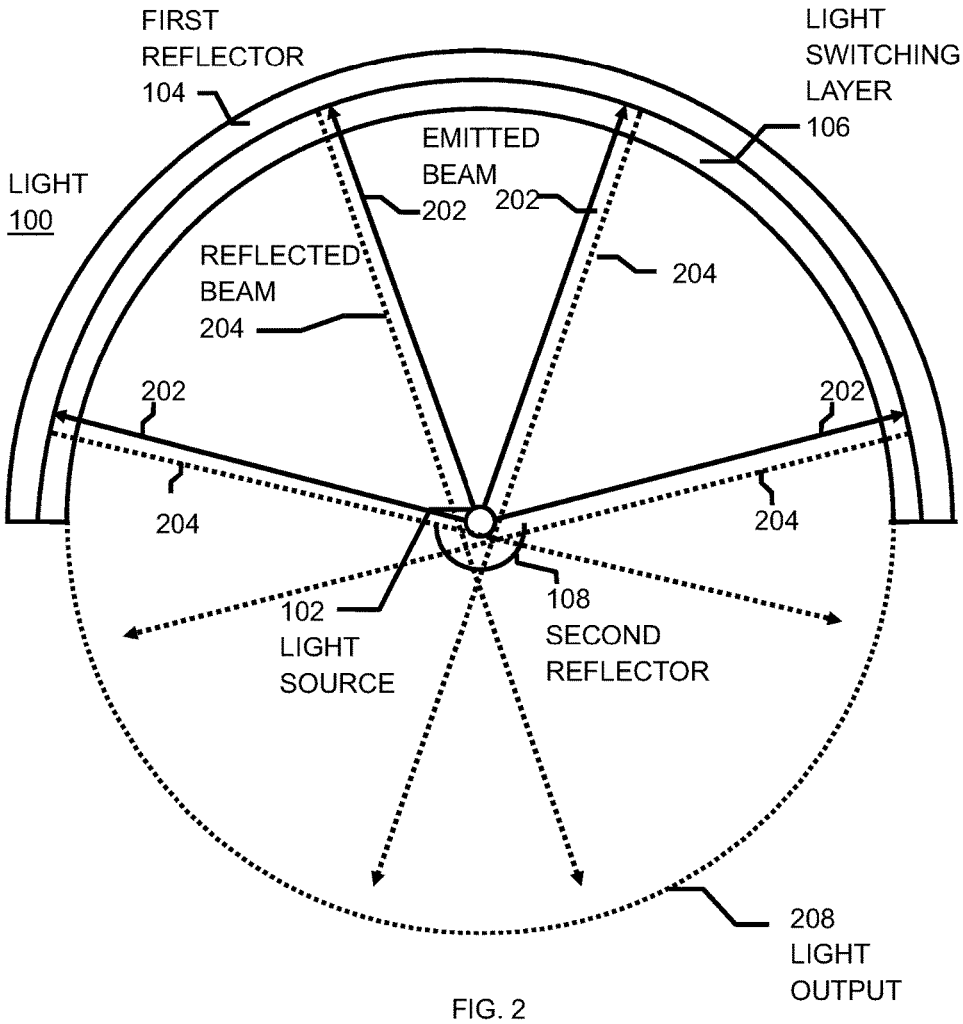
FIG. 2 shows light beams emerging from the directable light of FIG. 1, all portions of the light switching layer of the directable light being configured to be transparent.

FIG. 2 shows reflected light beams 204 emerging from the light 100, all portions of the light switching layer 106 of the light 100 being configured in the first state, that is, substantially transparent to the generated light. In the first state, light emitted 202 from the light source 102 passes through the light switching layer 106 to reach the first reflector 104 where it is reflected back to return through the light switching layer 106 and exit 204 the light 100. Light switching layer 106 is typically a liquid crystal display (LCD) layer. FIG. 2 shows four such beams as examples, but light source 102 will typically emit light beams in every direction, thus providing a continuum of emitted light beams 202 to each point on the first reflector 104 and a continuum of reflected beams 204 exiting the light 100.

Figure 3:
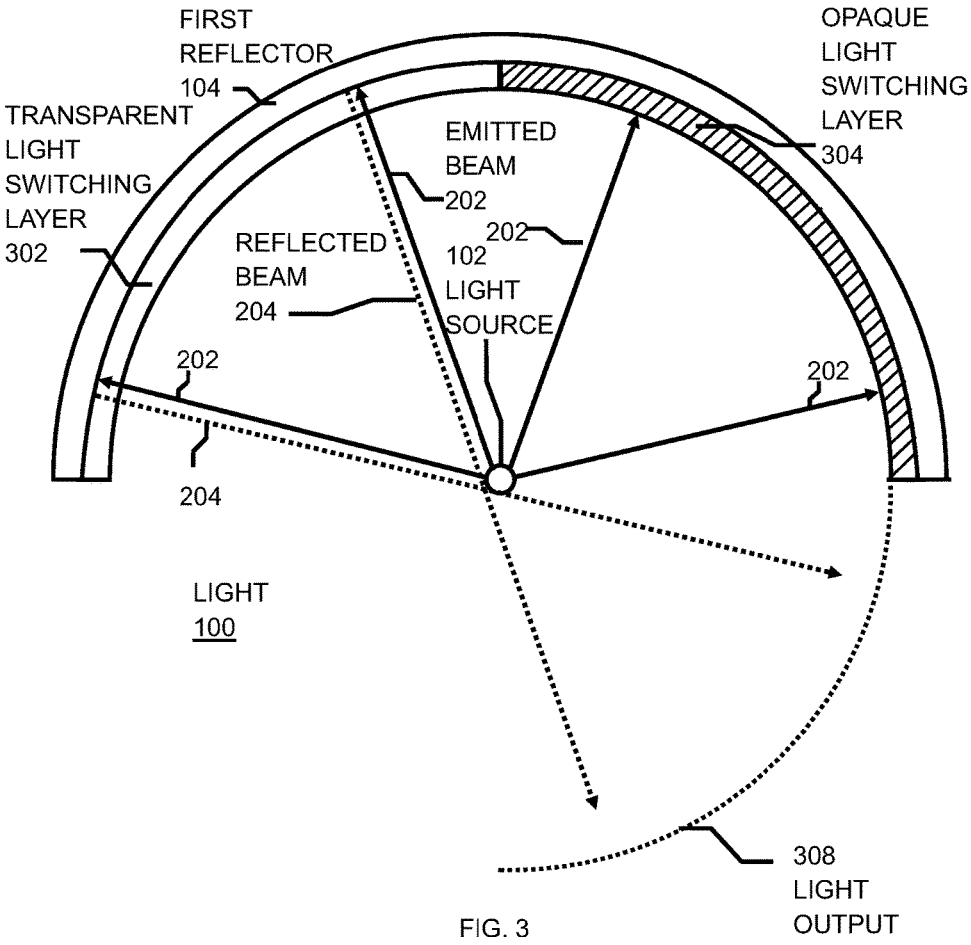
FIG. 3 shows light beams emerging from the directable light of FIG. 1, with some portions of the light switching layer of the directable light being configured to be transparent and some portions being configured to be opaque.

FIG. 3 shows reflected light beams 204 emerging from the light 100 of FIG. 1, with transparent light switching layer portions 302 being configured to be transparent and opaque light switching layer portions 304 (shown hashed in FIG. 3) being configured to be opaque. Emitted beams 202 reaching the transparent light switching layer 302 from the light source 102 pass through the transparent light switching layer 302 to reach the first reflector 104 where they are reflected back to return through the transparent light switching layer 302 and exit 204 the light 100. Emitted beams 202 reaching the opaque light switching layer 304 (shown hashed) from the light source 102 do not pass through the opaque light switching layer 304 and do not reach the first reflector 104. These emitted beams 202 are not reflected back and do not exit the light 100. The positioning of the transparent light switching layer 302 and the opaque light switching layer 304 in FIG. 3 results in a beam pattern that is illuminated on one half of the central axis 110 and not illuminated on the other half of the central axis 110. Although FIG. 3 shows a single transparent switching layer 302 and a single opaque switching layer 304, any number of separate or conjoined transparent switching layers 302 and any number of separate or conjoined opaque switching layers 304 may be used to create any directed beam pattern. When viewed in three dimensions, the transparent switching layers 302 and the opaque switching layers 304 may form any shape. Optional second reflector 108 has been omitted from FIG. 3 and the subsequent figures for the purposes of clarity.

Figure 4:
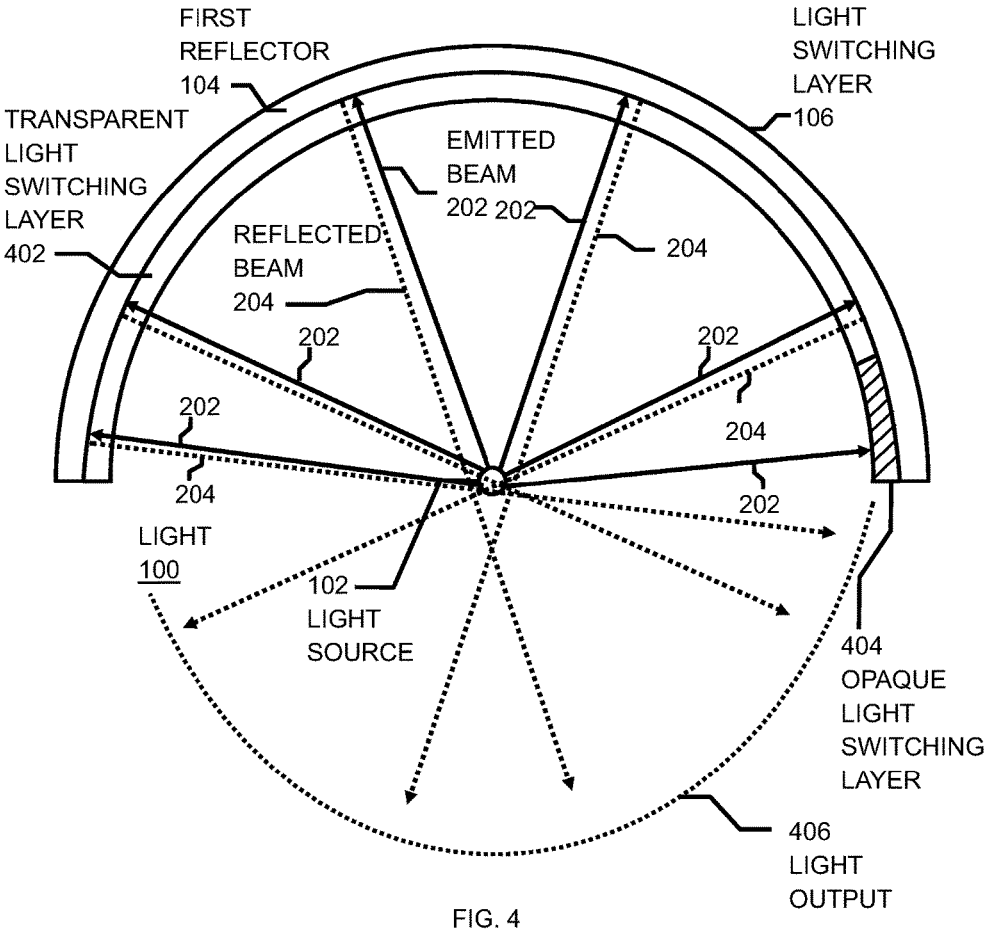
FIG. 4 shows light beams emerging from the directable light of FIG. 1, with some portions of the light switching layer of the directable light being configured to be opaque so as to produce a beam pattern suitable for countries driving on the left hand side of the road.

FIG. 4 shows reflected light beams 204 emerging from the light 100 of FIG. 1, with transparent light switching layer portion 402 being configured to be transparent and opaque light switching layer portion 404 (shown hashed) configured to not be illuminated so as to produce a beam pattern suitable for countries driving on the left hand side of the road. Light beams which would emerge to the right hand side of the road into the face of oncoming traffic are blocked by the opaque light switching layer 404. This results in a beam pattern shown by light output 406. Optional second reflector 108 has been omitted from FIG. 4 for the purposes of clarity.

Currently, there are 55 countries which drive on the left hand side of the road, including the United Kingdom, Ireland, Cyprus, Malta, India, Japan, Malaysia, Thailand, South Africa, Australia and New Zealand. Further Guyana, which drives on the left hand side has land borders with Venezuela and Brazil who drive on the right hand side and Suriname which drives on the left hand side has land borders with Brazil and French Guiana who drive on the right hand side. Further Thailand, which drives on the left hand side has land borders with Myanmar and Laos who drive on the right hand side and Suriname which drives on the left hand side has land borders with Brazil and French Guiana who drive on the right hand side. Further India, Pakistan, Bangladesh, Bhutan and Nepal, which all drive on the left hand side have land borders with Iran, Afghanistan, Tajikistan, Myanmar and China who all drive on the right hand side. Further Namibia, Zambia, Tanzania, Uganda and Kenya, which all drive on the left hand side have land borders with Angola, Democratic Republic of Congo, Rwanda, Burundi, South Sudan, Ethiopia and Somalia who all drive on the right hand side.

Figure 5:
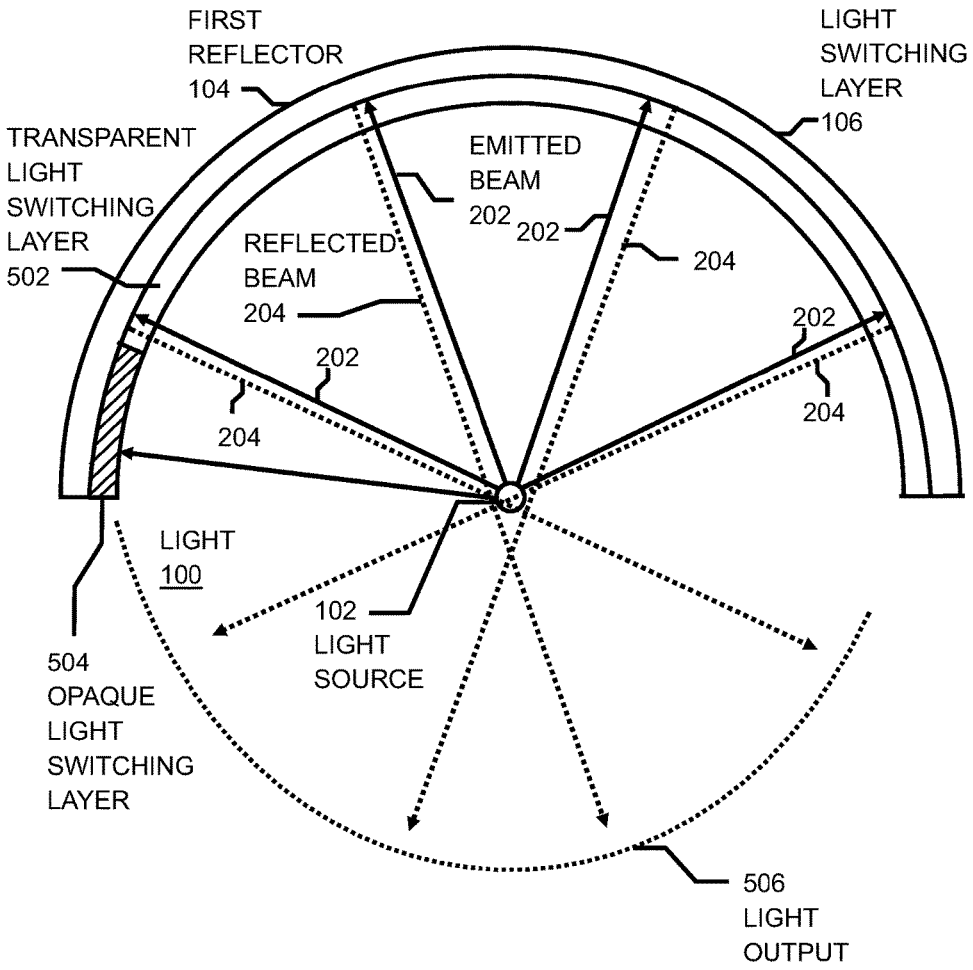
FIG. 5 shows light beams emerging from the directable light of FIG. 1, with some portions of the light switching layer of the directable light being configured to be opaque so as to produce a beam pattern suitable for countries driving on the right hand side of the road.

FIG. 5 shows reflected light beams 204 emerging from the light 100 of FIG. 1, with transparent light switching layer portion 502 being configured to be transparent and opaque light switching layer portions 504, 506 configured to not be illuminated so as to produce a beam pattern suitable for countries driving on the right hand side of the road. Light beams which would emerge to the left hand side of the road into the face of oncoming traffic are blocked by the opaque light switching layer 506. Optional second reflector 108 has been omitted from FIG. 5 for the purposes of clarity. Many more countries drive on the right hand side of the road than drive of the left hand side of the road, including the United States, Canada, Russia, China, Middle Eastern countries and North and Central African countries.

Figure 6:
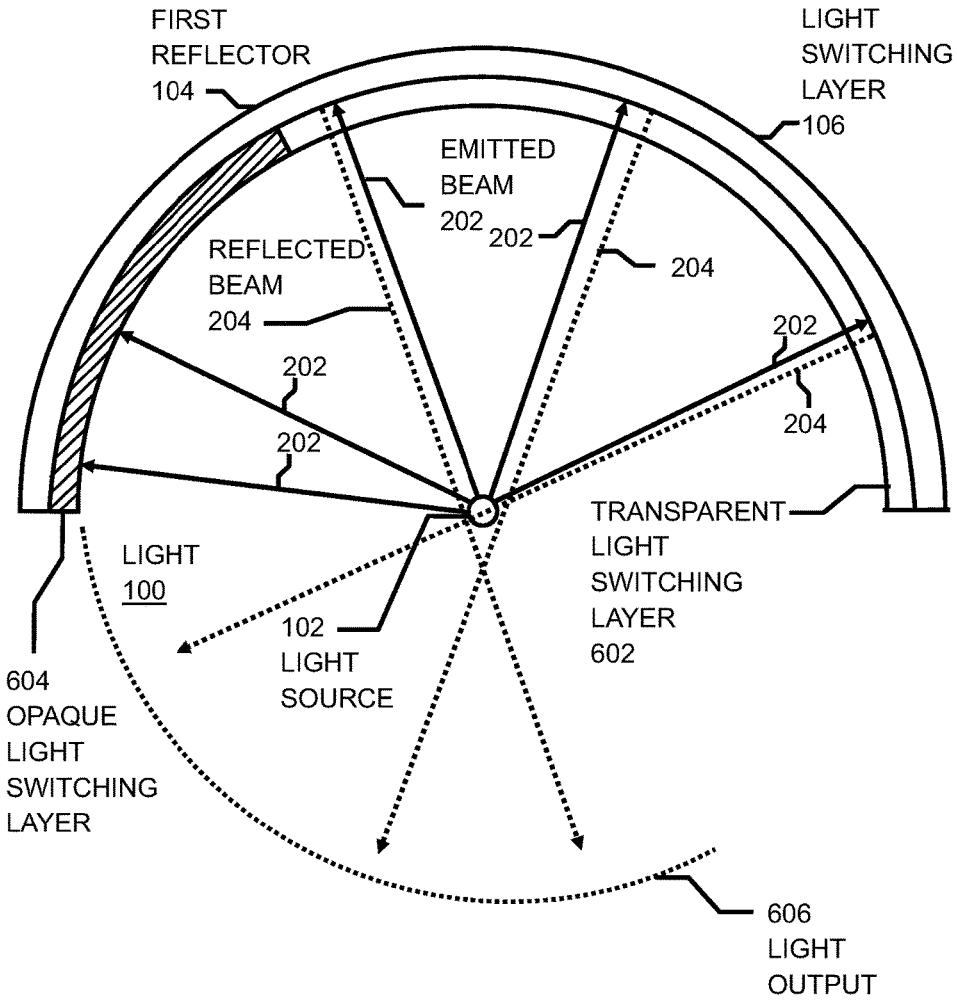
FIG. 6 shows light beams emerging from the directable light of FIG. 1, with some portions of the light switching layer of the directable light being configured to be opaque so as to produce a beam pattern suitable for a vehicle steering to the right.

FIG. 6 shows light beams emerging from the light 100 of FIG. 1, with light switching layer portion 602 configured to be transparent and light switching layer portion 604 configured to be opaque so as to produce a beam pattern suitable for a vehicle steering to the right. Light beams 202 which travel from the light source towards opaque light switching layer portion 604 are absorbed and do not reach first reflector 104 and thus are not reflected out of the light 100. Light beams 202 which travel from the light source towards transparent light switching layer portion 602 pass through transparent light switching layer portion 602, reach first reflector 104 and are then reflected out of the light 100 to produce light output 606. Typically, the light output shown in FIG. 6 is used when a vehicle is steering to the right, that is towards the lower left corner of the drawing. Inputs from the vehicle are used to determine which portions of the light switching layer 106 are configured to be transparent and which portions are configured to be opaque. As the vehicle is steered to the right and to the left, these inputs provide the information that is used to configure the portions. Optional second reflector 108 has been omitted from FIG. 6 for the purposes of clarity.

When the vehicle is steering in a straight line, the light output may be offset, as shown in FIG. 4 and FIG. 5, to maximize the light output towards the curb and to minimize the light output towards oncoming vehicles. When steering to the right in the example of FIG. 6, a left hand drive vehicle configured to drive on the right hand side of the road, the light output is moved further to the right in the intended direction of travel of the vehicle. When steering to the left in the example of FIG. 6, a left hand drive vehicle configured to drive on the right hand side of the road, the light output is moved to the left in the intended direction of travel of the vehicle. As there is an offset to the right to minimize the light output towards oncoming vehicles, this may result in the light output being in a direction straight ahead of the vehicle. In embodiments of the invention there may be more than one transparent light switching portion 602 and/or more than one opaque light switching portion 604.

Figure 7:
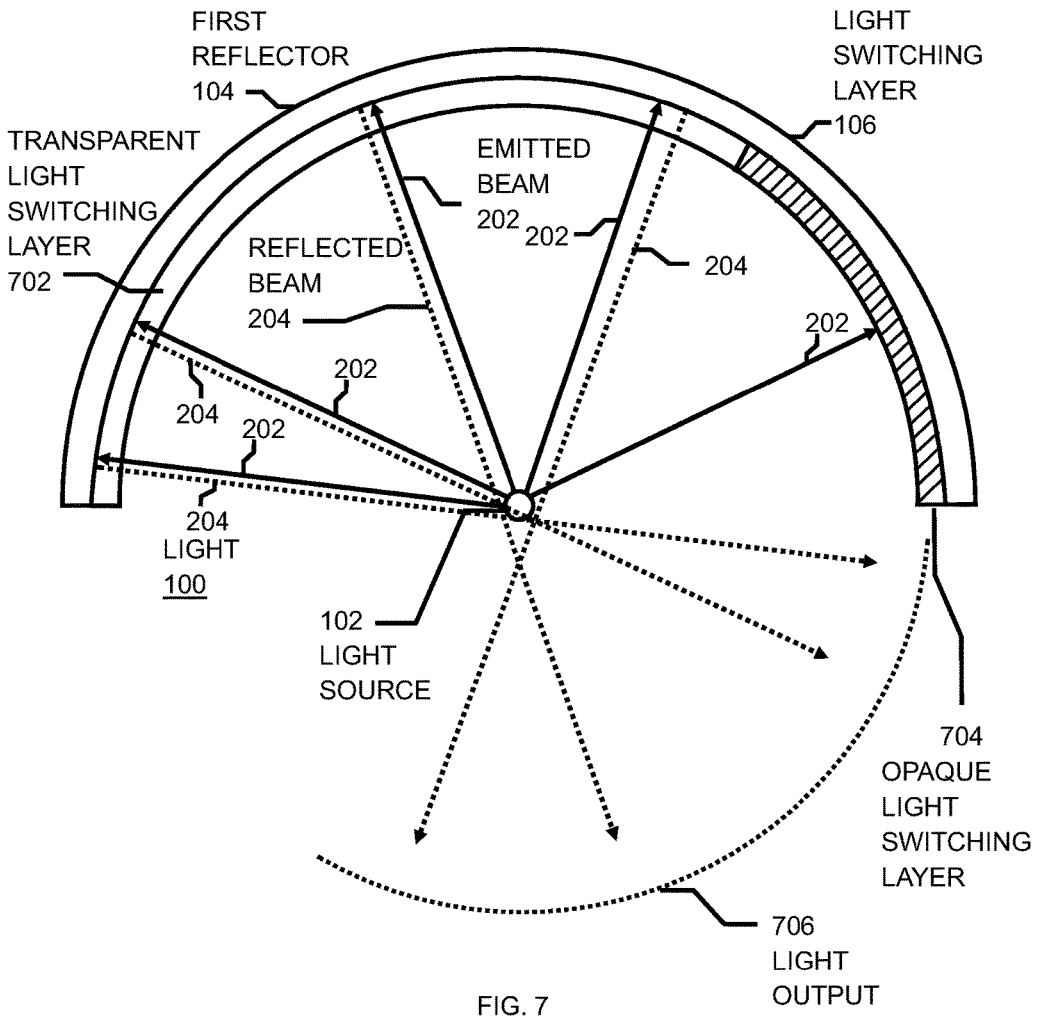
FIG. 7 shows light beams emerging from the directable light of FIG. 1, with some portions of the light switching layer of the directable light being configured to be opaque so as to produce a beam pattern suitable for a vehicle steering to the left.

FIG. 7 shows light beams emerging from the light 100 of FIG. 1, with light switching layer portion 702 configured to be transparent and light switching layer portion 704 configured to be opaque so as to produce a beam pattern suitable for a vehicle steering to the left. Light beams 202 which travel from the light source towards opaque light switching layer portion 704 are absorbed and do not reach first reflector 104 and thus are not reflected out of the light 100. Light beams 202 which travel from the light source towards transparent light switching layer portion 702 pass through transparent light switching layer portion 702, reach first reflector 104 and are then reflected out of the light 100 to produce light output 706. Typically, the light output shown in FIG. 7 is used when a vehicle is steering to the right, that is towards the lower left corner of the drawing. Inputs from the vehicle are used to determine which portions of the light switching layer 106 are configured to be transparent and which portions are configured to be opaque. As the vehicle is steered to the right and to the left, these inputs provide the information that is used to configure the portions. In embodiments of the invention there may be more than one transparent light switching portion 702 and/or more than one opaque light switching portion 704. Optional second reflector 108 has been omitted from FIG. 7 for the purposes of clarity.

Whilst the embodiment of FIGS. 6 and 7 has been described with reference to light switching layer portion 602, 702 being configuring to be transparent and light switching layer portion 604, 704 being configuring to be opaque so as to produce a beam pattern suitable for a vehicle steering to the left or a vehicle steering to the right, other combinations of transparency and opaqueness are possible. In an embodiment, light switching layer portions may be configured so as to control the direction of the beam in a vertical direction. This may be done alone, or in combination with control of the direction of the beam in a horizontal direction.

In this embodiment, the control may be substantially static, that is, the directable light 100 is controlled to provide a cutoff for the beam so as to avoid dazzling traffic traveling towards the light source 100. That cutoff may be varied to provide an adjustment to the cutoff level, for example at manufacture or in order to meet vehicle testing standards. That cutoff may also be varied to provide, for example a lower cutoff when there is oncoming traffic traveling towards the light source 100 and a higher cutoff level when there is no oncoming traffic traveling towards the light source 100.

In other embodiments, the control may be substantially dynamic, either alone or in combination with one or more of the substantially static embodiments described above, so as to direct the beam to maintain a substantially constant angle to the ground. Dynamic inputs may include those from a suspension height sensor fitted to either or both of the front suspension or the rear suspension. These dynamic inputs may reflect short term disturbances, such as a vehicle traveling over a bump in the road, or they may reflect longer term disturbances, such as the vehicle being loaded with passengers or with luggage and/or other items.

Figure 8:
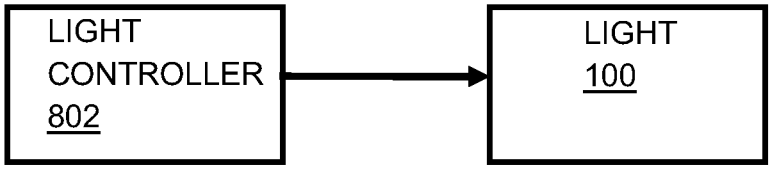
FIG. 8 shows the directable light of FIG. 1, together with a light controller for determining which portions of the light switching layer are configured to be opaque and which portions are configured to be transparent.

FIG. 8 shows the directable light 100 of FIG. 1, together with a light controller 802 for determining which portions of the light switching layer 106 are configured to be opaque portions 304, 404, 504, 604, 704 and which portions are configured to be transparent portions 302, 402, 502, 602, 702. Light controller 802 controls each portion of the light switching layer. Such control may be by direct connection between the light controller 802 and the portions or it may be by a multiplexed connection. Light controller may receive inputs from any number of sources, including, for example, software within the vehicle indicating whether the beam patterns should be set for left hand side driving or right hand side driving. Light controller may be programmed when the vehicle is manufactured. Light controller may receive input directly from a switch. These inputs may be used to control the light output 406, 506 according to which side of the road the vehicle is intended to be driven on.

Light controller 802 may also receive input as to the intended direction of travel of the vehicle, such as, for example, the position of the steering wheel or from sensors associated with dynamic stability control systems in the vehicle. These inputs may be used to control the light output 606, 706 according to what the intended direction of travel of the vehicle is.

Figure 9:
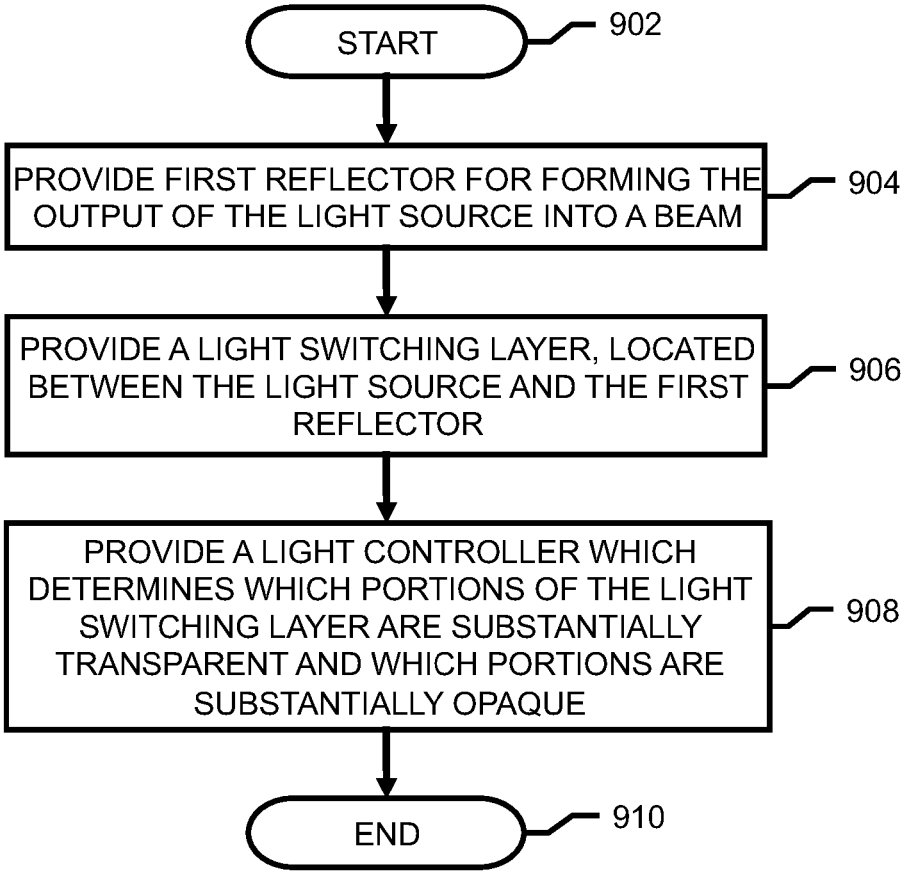
FIG. 9 is a flow chart of a method of configuring the output of a directable light.

FIG. 9 is a flow chart of a method of configuring the output of a light source in a vehicle. The method starts at step 902. At step 904 a first reflector is provided for forming the output of the light source into a beam. The first reflector located in directions contained within a hemisphere centered on the light source. At step 906, a light switching layer is provided, located between the light source and the first reflector. The light switching layer comprises a plurality of portions, each portion having at least two states, in a first state being substantially transparent to the generated light and in a second state being substantially opaque to the generated light. At step 908, a light controller is provided which determines which portions of the light switching layer are substantially transparent and which portions are substantially opaque. The method ends at step 910.

The present invention may be a system and/or a method. The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A directable light, the light comprising:

a light source for generating light;

a first reflector for forming said generated light into a beam;

a light switching layer, located between said light source and said first reflector such that said generated light travels through said light switching layer prior to being reflected by said first reflector, said light switching layer comprising a plurality of portions, each of said portions having at least two states, in a first state said light switching layer being substantially transparent to said generated light and in a second state said light switching layer being substantially opaque to said generated light; and a light controller which determines which of said portions of said light switching layer are substantially transparent and which of said portions of said light switching layer are substantially opaque.

2. The light of claim 1, wherein said light switching layer comprises a liquid crystal panel.

3. The light of claim 1, wherein at least a first portion of said first reflector is located at a different distance from said light source from at least a second portion of said first reflector.

4. The light of claim 1, wherein said light controller comprises a first predetermined configuration which causes said switching layer to have portions which are substantially transparent and portions which are substantially opaque so as to direct said beam to the right, suitable for a vehicle used on a road where vehicles drive on the right hand side of the road and a second predetermined configuration which causes said switching layer to have portions which are substantially transparent and portions which are substantially opaque so as to direct said beam to the left, suitable for a vehicle used on a road where vehicles drive on the left hand side of the road.

5. The light of claim 1, wherein said light controller comprises a predetermined configuration which causes said switching layer to have portions which are substantially transparent and portions which are substantially opaque so as to direct said beam according to the intended direction of travel of the vehicle.

6. The light of claim 1, wherein said light controller comprises a predetermined configuration which causes said switching layer to have portions which are substantially transparent and portions which are substantially opaque so as to direct said beam to vary the beam angle relative to the ground.

7. The light of claim 1, wherein said light controller comprises a predetermined configuration which causes said switching layer to have portions which are substantially transparent and portions which are substantially opaque so as to direct said beam to maintain a substantially constant angle relative to the ground.

8. A method of configuring the output of a light source in a vehicle, the method comprising:

providing a first reflector for forming the output of the light source into a beam, the first reflector located in directions contained within a hemisphere centered on the light source;

providing a light switching layer, located between the light source and the first reflector such that generated light of the light source travels through the light switching layer prior to being reflected by the first reflector, the light switching layer comprising a plurality of portions, each portion having at least two states, in a first state being substantially transparent to the generated light and in a second state being substantially opaque to the generated light; and providing a light controller which determines which portions of the light switching layer are substantially transparent and which portions are substantially opaque.

9. The method of claim 8, further comprising providing a first predetermined configuration which causes said switching layer to have portions which are substantially transparent and portions which are substantially opaque so as to direct said beam to the right, suitable for a vehicle used on a road where vehicles drive on the right hand side of the road and providing a second predetermined configuration which causes said switching layer to have portions which are substantially transparent and portions which are substantially opaque so as to direct said beam to the left, suitable for a vehicle used on a road where vehicles drive on the left hand side of the road.

10. The method of claim 8, further comprising providing a predetermined configuration which causes said switching layer to have portions which are substantially transparent and portions which are substantially opaque so as to direct said beam according to the intended direction of travel of the vehicle.

11. The method of claim 8, further comprising providing a predetermined configuration which causes said switching layer to have portions which are substantially transparent and portions which are substantially opaque so as to direct said beam to vary the beam angle relative to the ground.

12. The method of claim 8, further comprising providing a predetermined configuration which causes said switching layer to have portions which are substantially transparent and portions which are substantially opaque so as to direct said beam to maintain a substantially constant angle to the ground.

* * * * *